US010217431B2

(12) United States Patent
Kim et al.

(10) Patent No.: US 10,217,431 B2
(45) Date of Patent: Feb. 26, 2019

(54) DISPLAY APPARATUS AND METHOD OF DRIVING THE SAME

(71) Applicant: SAMSUNG DISPLAY CO., LTD., Yongin-si, Gyeonggi-Do (KR)

(72) Inventors: Kyunho Kim, Cheonan-si (KR); Sung-In Kang, Hwaseong-si (KR); Seunghwan Moon, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 89 days.

(21) Appl. No.: 15/380,804

(22) Filed: Dec. 15, 2016

(65) Prior Publication Data

US 2017/0193953 A1 Jul. 6, 2017

(30) Foreign Application Priority Data

Dec. 30, 2015 (KR) ..... 10-2015-0190167

(51) Int. Cl.
*G09G 3/36* (2006.01)

(52) U.S. Cl.
CPC ..... *G09G 3/3685* (2013.01); *G09G 3/3674* (2013.01); *G09G 3/3696* (2013.01); *G09G 2300/043* (2013.01); *G09G 2300/0426* (2013.01); *G09G 2310/08* (2013.01)

(58) Field of Classification Search
CPC ..... G09G 2300/0426; G09G 2300/043; G09G 2310/08; G09G 3/3674; G09G 3/3685; G09G 3/3696
See application file for complete search history.

(56) References Cited

U.S. PATENT DOCUMENTS 8,416,223 B2 * 4/2013 Yajima ..... H05K 1/117 345/204
9,892,701 B2 * 2/2018 Park ..... G09G 3/3648
2005/0057477 A1 * 3/2005 Yun ..... G02F 1/13452 345/93
2006/0066553 A1 * 3/2006 Deane ..... G09G 3/3648 345/98
2008/0204434 A1 * 8/2008 Lee ..... G02F 1/1345 345/205
2009/0040166 A1 * 2/2009 Lee ..... G02F 1/1345 345/98
2009/0219263 A1 * 9/2009 Shino ..... G09G 3/20 345/204

(Continued)

FOREIGN PATENT DOCUMENTS

KR 10-0237679 1/2000

*Primary Examiner* — Kent W Chang
*Assistant Examiner* — Nathaniel P Brittingham
(74) *Attorney, Agent, or Firm* — F.Chau & Associates, LLC

(57) ABSTRACT

A display apparatus includes a display panel having fan-out lines, data lines, a first dummy line, and a second dummy line. The fan-out lines are sequentially disposed along a first direction. The data lines are connected to the fan-out lines at first through nodes. The first dummy line is connected to one of the nodes. The second dummy line is connected to another of the nodes. A first data driver is configured to output data voltages to some of the fan-out lines based on a data signal. A second data driver is configured to output voltages to other fan-out lines based on the data signal. A timing controller is configured to compensate the data signal based on a voltage of nodes that the dummy lines are connected to.

18 Claims, 11 Drawing Sheets

(56) References Cited

U.S. PATENT DOCUMENTS

2009/0310051 A1* 12/2009 Kim ..... G02F 1/136204 349/40
2010/0110058 A1* 5/2010 Moh ..... G09G 3/3655 345/211
2010/0225770 A1* 9/2010 Morimoto ..... G09G 3/006 348/189
2010/0295829 A1* 11/2010 Kwon ..... G09G 3/006 345/205
2011/0096449 A1* 4/2011 Lee ..... G02F 1/1345 361/91.1
2012/0169578 A1* 7/2012 Kim ..... G09G 3/3688 345/93
2013/0027378 A1* 1/2013 Lee ..... G09G 3/3677 345/212
2013/0155037 A1* 6/2013 Kim ..... G09G 3/006 345/204
2013/0187838 A1* 7/2013 Kiriyama ..... H01J 11/12 345/60
2013/0293526 A1* 11/2013 Igawa ..... G09G 3/3696 345/212
2014/0028535 A1* 1/2014 Min ..... G09G 3/18 345/87
2014/0118277 A1* 5/2014 Kim ..... G06F 3/044 345/173
2015/0091444 A1* 4/2015 Ebisuno ..... H05B 33/0896 315/125
2015/0379948 A1* 12/2015 Ohishi ..... G02F 1/136286 345/92
2016/0098965 A1* 4/2016 Chiu ..... G02F 1/1345 345/92
2016/0163279 A1* 6/2016 Hong ..... G02F 1/1345 345/212
2016/0365062 A1* 12/2016 Wu ..... G09G 5/003
2017/0193953 A1* 7/2017 Kim ..... G09G 3/3674

* cited by examiner

DISPLAY APPARATUS AND METHOD OF DRIVING THE SAME

CROSS-REFERENCE TO RELATED APPLICATION

This application claims priority under 35 U.S.C. § 119 to Korean Patent Application No. 10-2015-0190167, filed on Dec. 30, 2015 in the Korean Intellectual Property Office (KIPO), the contents of which are herein incorporated by reference in their entireties.

TECHNICAL FIELD

Exemplary embodiments of the present inventive concept relate generally to display devices, and more particularly to display apparatuses and methods of driving the display apparatuses.

DISCUSSION OF THE RELATED ART

Generally, a liquid crystal display ("LCD") apparatus includes a first substrate having a pixel electrode, a second substrate having a common electrode, and a liquid crystal layer disposed between the first and second substrates. Voltages are applied to each electrode and accordingly, an electric field that passes through the liquid crystal layer is generated. By adjusting an intensity of the electric field, a transmittance of a light passing through the liquid crystal layer may be adjusted so that a desired image may be displayed.

The LCD apparatus includes a display panel and a panel driver. The display panel includes gate lines, data lines, and pixels. Each pixel is connected to a gate line and a data line. The panel driver includes a gate driver providing gate signals to the gate lines and a data driver providing data voltages to the data lines.

The data driver may include one or more data driving ICs. The data lines are connected to the driving ICs through fan-out lines disposed on the display panel. Accordingly, the lengths of the fan-out lines are different from each other. Consequently, resistances of the fan-out lines are different from each other, and this may reduce image quality of the display device.

SUMMARY

A display apparatus includes a display panel having first through m-th fan-out lines, first through m-th data lines, a first dummy line, and a second dummy line. The first through m-th fan-out lines are sequentially disposed along a first direction. The first through m-th data lines are connected to the first through m-th fan-out lines at first through m-th nodes, respectively. The first dummy line is connected to the n-th node. The second dummy line is connected to the (n+1)-th node. Here, m and n are positive integers and m is greater than n. A first data driver is configured to output first through n-th data voltages to the first through n-th fan-out lines, respectively, based on a data signal. A second data driver is configured to output (n+1)-th through m-th data voltages to the (n+1)-th through m-th fan-out lines, respectively, based on the data signal. A timing controller is configured to compensate the data signal based on a voltage of the n-th node and a voltage of the (n+1)-th node.

A method of driving a display apparatus includes outputting first through n-th data voltages to first ends of first through n-th fan-out lines, respectively, based on a data signal, wherein n is a positive integer. Data voltages (n+1)-th through m-th are provided to first ends of (n+1)-th through m-th fan-out lines, respectively, based on the data signal. Here, m is a positive integer greater than n. An n-th voltage of a second end of the n-th fan-out line is obtained through a first dummy line. An (n+1)-th voltage of a second end of the (n+1)-th fan-out line is obtained through a second dummy line. The data signal is compensated based on the n-th and (n+1)-th voltages.

A display apparatus includes a display panel having a first display area and a second display area. A first data driver drives the first display area and a second data driver drives the second display area. A first set of data lines runs down the first display area and a second set of data lines runs down the second display area. A first set of fan-out lines connects the first set of data lines to the first data driver and a second set of fan-out lines connects the second set of data lines to the second data driver. A first dummy line and a second dummy line are each disposed between the first and second sets of fan-out lines. The first data driver provides a first data signal to the first set of fan-out lines and a first reference signal to the first dummy line. The second data driver provides a second data signal to the second set of fan-out lines and a second reference signal to the second dummy line.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION OF EMBODIMENTS

Hereinafter, exemplary embodiments of the present inventive concept will be explained in detail with reference to the accompanying drawings.

Figure 1:
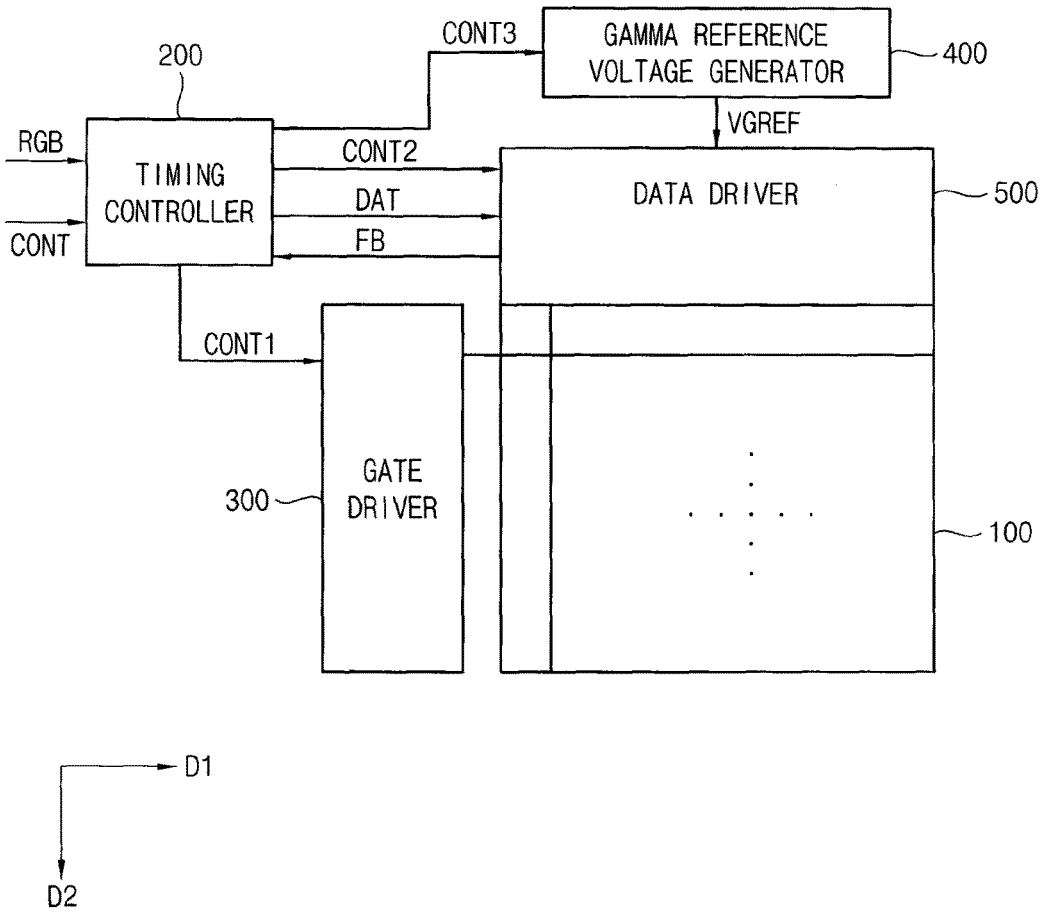
FIG. 1 is a block diagram illustrating a display apparatus according to exemplary embodiments of the present invention.

FIG. 1 is a block diagram illustrating a display apparatus according to exemplary embodiments of the present invention.

Referring to FIG. 1, the display apparatus includes a display panel 100 and a panel driver. The panel driver includes a timing controller 200, a gate driver 300, a gamma reference voltage generator 400, and a data driver 500.

The display panel 100 includes a display region for displaying an image and a peripheral region adjacent to the display region on which an image is not displayed.

The display panel 100 includes a plurality of gate lines GL, a plurality of data lines DL, and a plurality of pixels, each electrically connected to one of the gate lines GL and one of the data lines DL. The gate lines GL extend in a first direction D1 and the data lines DL extend in a second direction D2 crossing (e.g. substantially perpendicular to) the first direction D1.

In some exemplary embodiments of the present invention, each of the pixels may include a switching element, a liquid crystal capacitor, and a storage capacitor. The liquid crystal capacitor and the storage capacitor may each be electrically connected to the switching element. The pixels may be arranged in a matrix configuration, however, other configurations (e.g. staggered configurations) may also be used.

The display panel 100 will be explained in detail with reference to FIGS. 2 and 3.

The timing controller 200 receives input image data RGB and an input control signal CONT from an external source. The input image data RGB may include red image data R, green image data G, and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DAT, based on the input image data RGB and the input control signal CONT.

The timing controller 200 generates the first control signal CONT1 for controlling operations of the gate driver 300 based on the input control signal CONT, and the timing controller 200 outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and the timing controller 200 outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500.

The timing controller 200 generates the third control signal CONT3 for controlling operations of the gamma reference voltage generator 400 based on the input control signal CONT, and the timing controller 200 outputs the third control signal CONT3 to the gamma reference voltage generator 400.

The operations of the timing controller 200 will be explained in detail with reference to FIGS. 4A through 4C and 5A through 5C.

The gate driver 300 generates gate signals for driving the gate lines GL in response to the first control signal CONT1 received from the timing controller 200. The gate driver 300 sequentially outputs the gate signals to the gate lines GL.

In some exemplary embodiments of the present invention, the gate driver 300 may be directly mounted on the display panel 100, or may be connected to the display panel 100 as a tape carrier package (TCP) type. Alternatively, the gate driver 300 may be disposed within the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In some exemplary embodiments of the present invention, the gamma reference voltage generator 400 may be disposed in the timing controller 200, or may be disposed in the data driver 500.

The data driver 500 receives the second control signal CONT2 and the data signal DAT from the timing controller 200, and the data driver 500 receives the gamma reference voltage VGREF from the gamma reference voltage generator 400. The data driver 500 converts the data signal DAT to data voltages having analogue levels that are based on the gamma reference voltage VGREF. The data driver 500 outputs the data voltages to the data lines DL.

The data driver 500 delivers a feedback signal FB from the display panel 100 to the timing controller 200.

The data driver 500 includes a first data driver 501 and a second data driver 502. The first data driver 501 and the second data driver 502 may each be instantiated as a data driving integrated circuit (IC).

In some exemplary embodiments of the present invention, the data driver 500 may be directly mounted on the display panel 100, or may be connected to the display panel 100 as a tape carrier package (TCP). Alternatively, the data driver 500 may be integrated on the peripheral region of the display panel 100.

The operations of the data driver 500 will be explained in detail with reference to FIG. 2.

Figure 2:
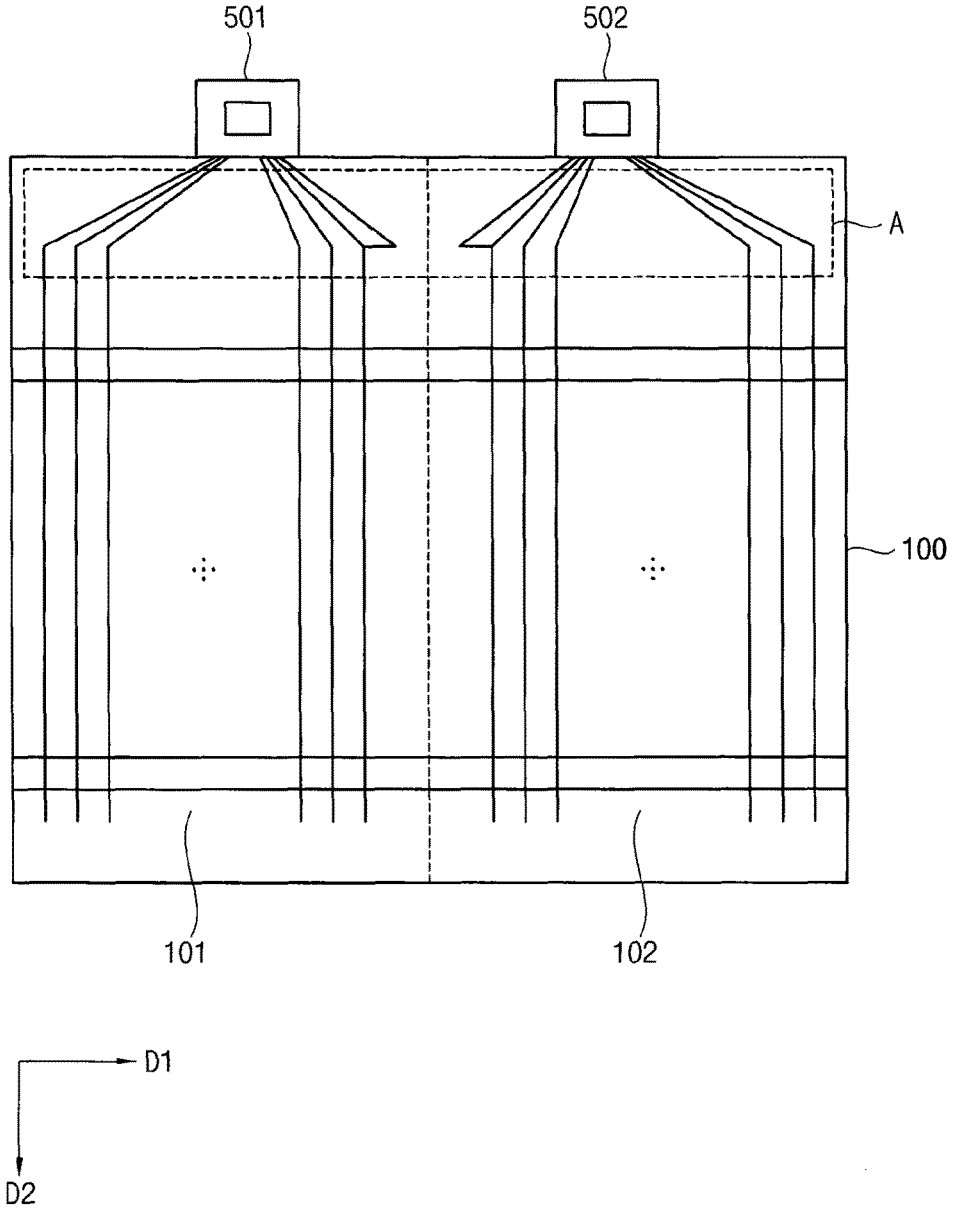
FIG. 2 is a schematic diagram illustrating a display panel and a data driver included in a display apparatus according to exemplary embodiments of the present invention.

FIG. 2 is a schematic diagram illustrating a display panel and a data driver included in a display apparatus according to exemplary embodiments of the present invention. FIG. 3 is an enlarged schematic diagram illustrating area A of FIG. 2.

Figure 3:
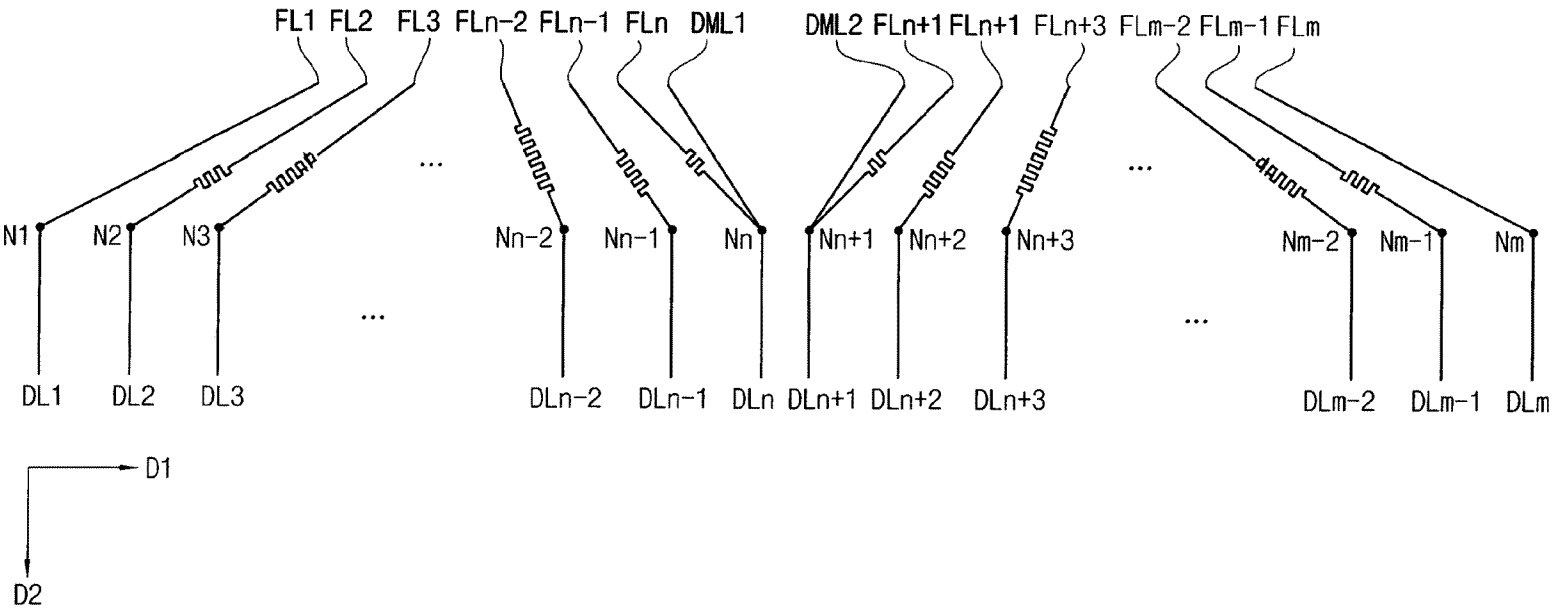
FIG. 3 is an enlarged schematic diagram illustrating area A of FIG. 2.

Referring to FIGS. 1 through 3, the display panel 100 includes first through m-th fan-out lines FL1-FLm, first and second dummy lines DML1, DML2, and first through m-th data lines DL11 DLm, where m is a positive integer.

The display panel 100 is divided into a first area 101 and a second area 102.

The first through n-th fan-out lines FL1-FLn, the first dummy line DML1 and the first through n-th data lines DL1-DLn are disposed in the first area 101, where n is a positive integer smaller than m. The (n+1)-th through m-th fan-out lines FLn+1-FLm, the second dummy line DML2 and the (n+1)-th through m-th data lines DLn+1-DLm are disposed in the second area 102.

The first through m-th fan-out lines FL1-FLm are connected to the first through m-th data lines DL1-DLm at first through m-th nodes N1-Nm. For example, the first fan-out line FL1 is connected to the first data line DL1 at the first node N1. The n-th fan-out line FLn is connected to the n-th data line DLn at the n-th node Nn. The (n+1)-th fan-out line FLn+1 is connected to the (n+1)-th data line DLn+1 at the (n+1)-th node Nn+1. The m-th fan-out line FLm is connected to the m-th data line DLm at the m-th node Nm.

Distances between the first data driver 501 and the first through n-th nodes N1-Nn are different from each other. However, lengths of the first through n-th fan-out lines FL1-FLn are substantially the same as each other. Accordingly, the first through n-th fan-out lines FL1-FLn are each twisted a different number of times relative to each other. Thus, the first through n-th fan-out lines FL1-FLn have different impedances from each other.

Distances between the second data driver 502 and the (n+1)-th through m-th nodes Nn+1-Nm are different from each other. However, lengths of the (n+1)-th through m-th fan-out lines FLn+1-FLm are substantially the same as each other. Accordingly, the (n+1)-th through m-th fan-out lines FLn+1-FLm are each twisted a different number of times relative to each other. Thus, the (n+1)-th through m-th fan-out lines FLn+1-FLm have different impedances from each other.

The first dummy line DML1 is connected to the n-th node Nn. The second dummy line DML2 is connected to the (n+1)-th node Nn+1.

The data driver 500 includes the first data driver 501 and the second driver 502. The first data driver 501 and the second driver 520 may each be a data driving IC, thus the data driver 500 may include two data driving ICs.

The first data driver 501 outputs first through n-th data voltages corresponding to the first through n-th data lines DL1-DLn to the first through n-th fan-out lines FL1-FLn. The second data driver 502 outputs (n+1)-th through m-th data voltages corresponding to the (n+1)-th through m-th data lines DLn+1-DLm to the (n+1)-th through m-th fan-out lines FLn+1-FLm.

The first dummy line DML1 delivers a voltage of the n-th node Nn to the timing controller 200. The second dummy line DML2 delivers a voltage of the (n+1)-th node Nn+1 to the timing controller 200.

Figure 4A:
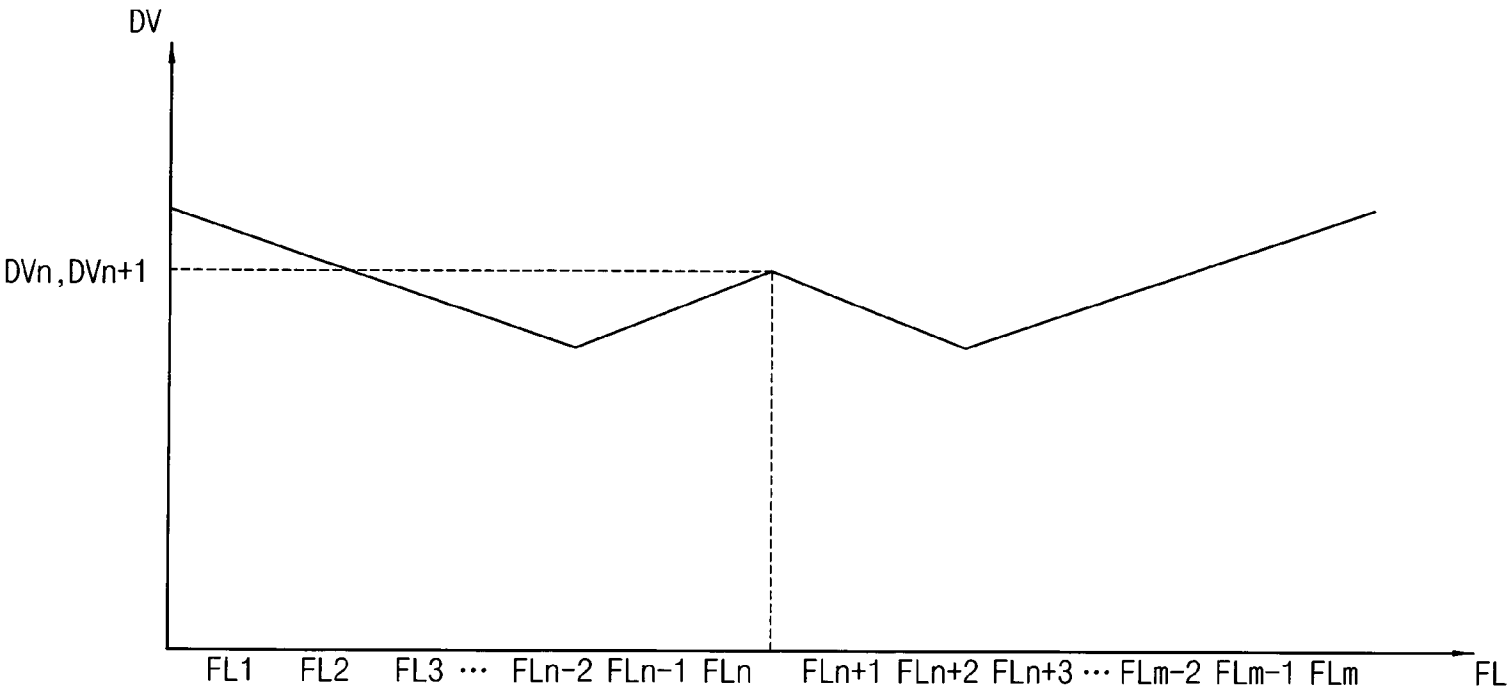
FIG. 4A is a graph illustrating first through m-th data voltages outputted to first through m-th fan-out lines included in a display apparatus according to exemplary embodiments of the present invention.

FIG. 4A is a graph illustrating first through m-th data voltages outputted to first through m-th fan-out lines included in a display apparatus according to exemplary embodiments of the present invention.

Referring to FIGS. 1 through 3 and 4A, the timing controller 200 generates the data signal DAT based on the input image data RGB. The timing controller 200 outputs first through n-th data to the first data driver 501. The first through n-th data is included in the data signal DAT, corresponding to the first through n-th data lines DL1-DLn.

The first data driver 501 generates first through n-th data voltages based on the first through n-th data.

The timing controller 200 generates the data signal DAT based on the input image data RGB. The timing controller 200 outputs (n+1)-th through m-th data to the second data driver 502. The (n+1)-th through m-th data is included in the data signal DAT, corresponding to the (n+1)-th through m-th data lines DLn+1-DLm.

The second data driver 502 generates (n+1)-th through m-th data voltages based on the (n+1)-th through m-th data.

FIG. 4A is a graph illustrating an example of the first through m-th data voltages DV. The n-th data line DLn is adjacent to the (n+1)-th data line DLn+1. Thus, the n-th data voltage DVn is substantially the same as the (n+1)-th data voltage DVn+1.

Figure 4B:
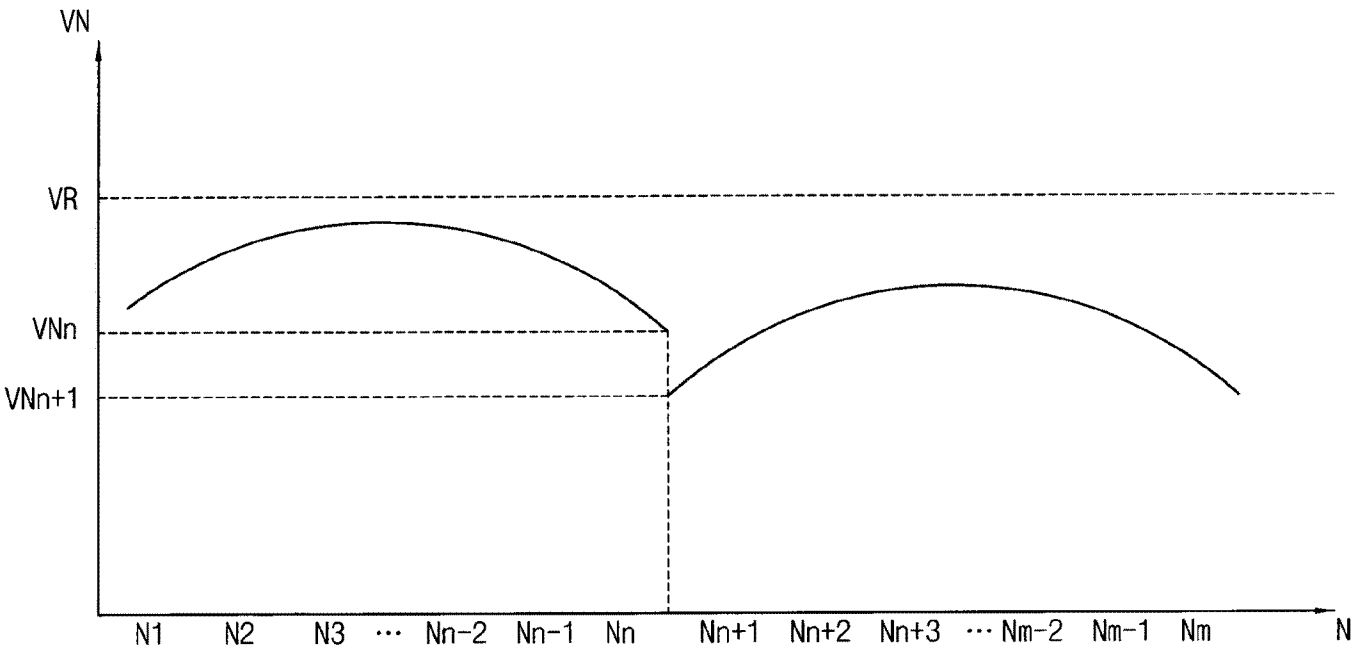
FIG. 4B is a graph illustrating first through m-th node voltages of first through m-th nodes included in a display apparatus, according to exemplary embodiments of the present invention, when first through m-th data voltages of FIG. 4A are outputted.
Figure 4C:
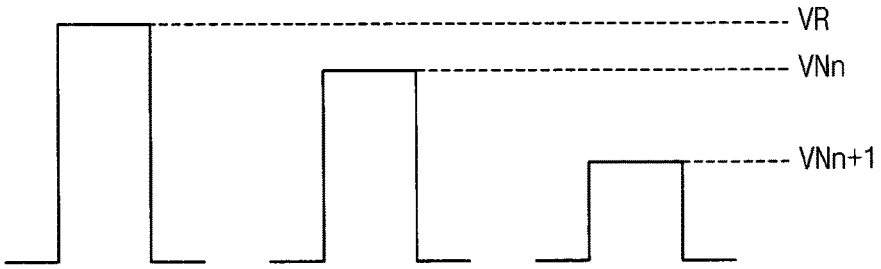
FIG. 4C is a diagram illustrating a reference voltage, an n-th node voltage, and an (n+1)-th node voltage, as shown in FIG. 4B.

FIG. 4B is a graph illustrating first through m-th node voltages of first through m-th nodes included in a display apparatus, according to exemplary embodiments of the present invention, when first through m-th data voltages of FIG. 4A are outputted. FIG. 4C is a diagram illustrating a reference voltage, an n-th node voltage, and an (n+1)-th node voltage in FIG. 4B.

Referring to FIGS. 1 through 3 and 4A through 4C, first through n-th node voltages of the first through n-th nodes N1-Nn are different from (n+1)-th through m-th node voltages of the (n+1)-th through m-th nodes Nn+1-Nm due to the different impedances of the first through m-th fan-out lines FL1~FLm. This difference is often most significant at an edge between the first area 101 and the second area 102, due to the difference between the n-th node voltage VNn and the (n+1)-th node voltage VNn+1.

The first dummy line DML1 delivers the n-th node voltage VNn to the timing controller 200. The second dummy line DML2 delivers the (n+1)-th node voltage VNn+1 to the timing controller 200.

Figure 5A:
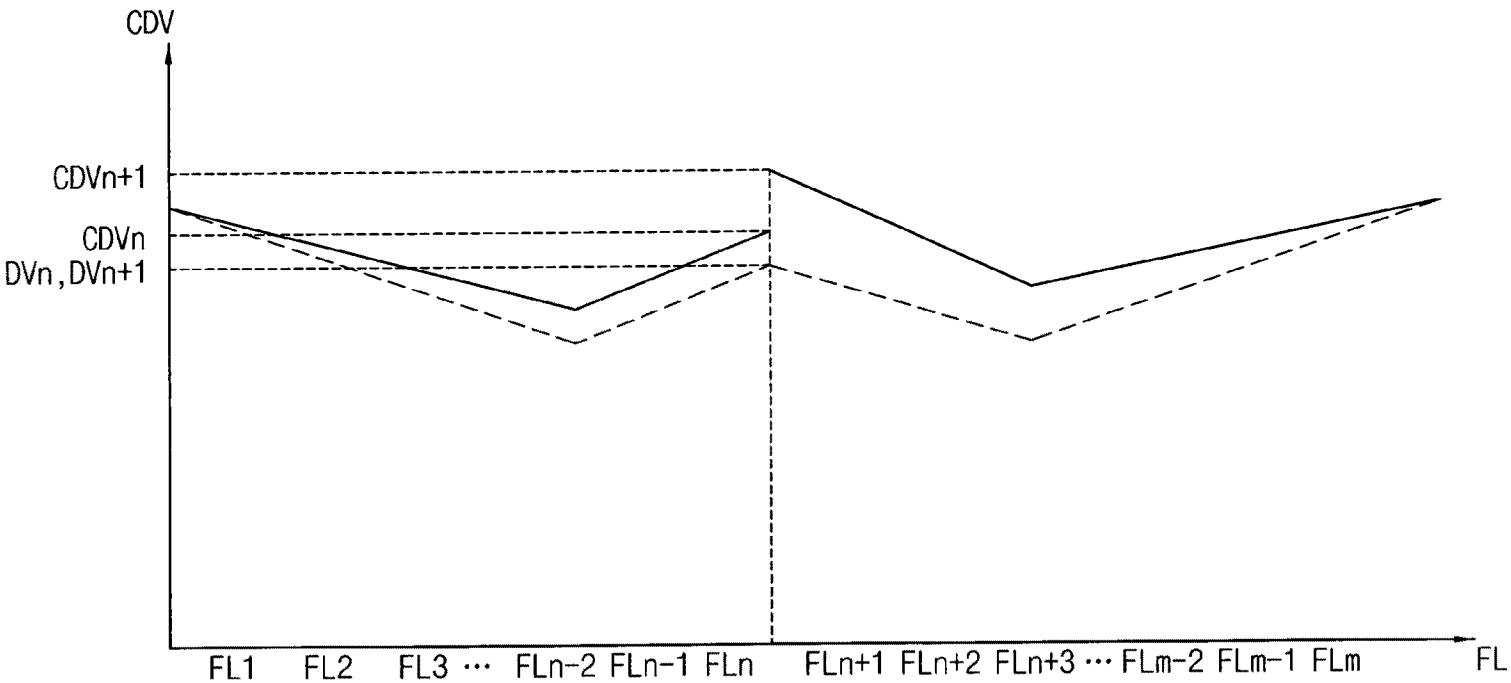
FIG. 5A is a graph illustrating compensated first through m-th data voltages outputted to first through m-th fan-out lines included in a display apparatus according to exemplary embodiments of the present invention.
Figure 5B:
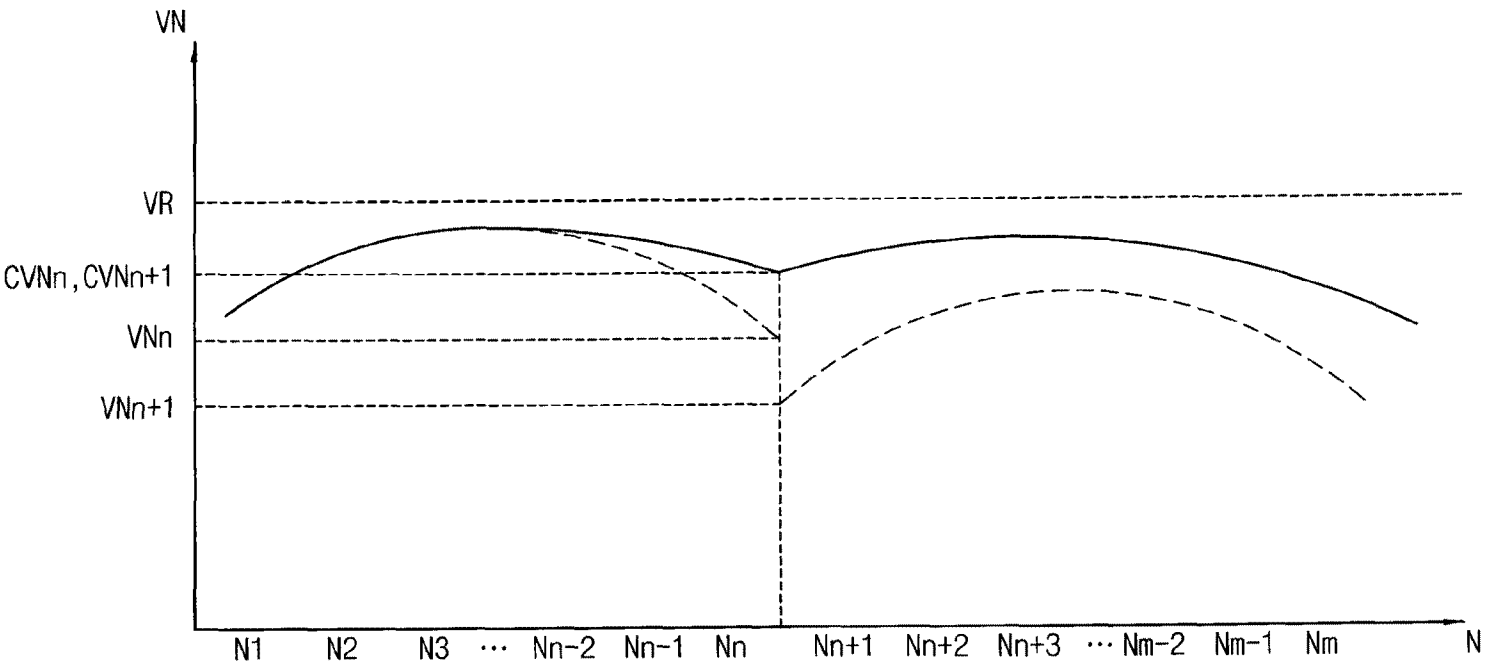
FIG. 5B is a graph illustrating compensated first through m-th node voltages of first through m-th nodes included in a display apparatus, according to exemplary embodiments of the present invention, when compensated first through m-th data voltages of FIG. 5A are outputted.
Figure 5C:
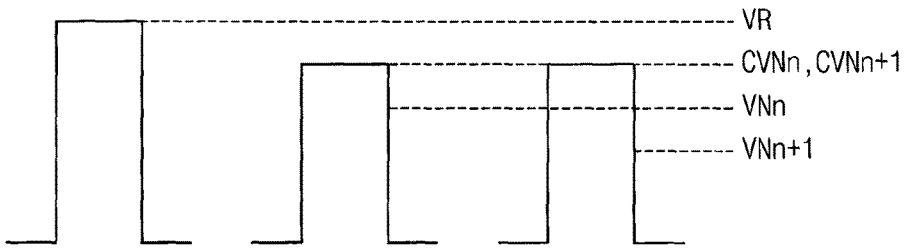
FIG. 5C is a diagram illustrating a reference voltage, a compensated n-th node voltage, and a compensated (n+1)-th node voltage, as shown in FIG. 5B.

FIG. 5A is a graph illustrating compensated first through m-th data voltages outputted to first through m-th fan-out lines included in a display apparatus according to exemplary embodiments of the present invention. FIG. 5B is a graph illustrating compensated first through m-th node voltages of first through m-th nodes included in a display apparatus, according to exemplary embodiments of the present invention, when compensated first through m-th data voltages of FIG. 5A are outputted. FIG. 5C is a diagram illustrating a reference voltage, a compensated n-th node voltage, and a compensated (n+1)-th node voltage in FIG. 5B.

Referring to FIGS. 1 through 3, 4A through 4C, and 5A through 5C, the timing controller 200 obtains the n-th node voltage VNn through the first dummy line DML1. The timing controller 200 obtains the (n+1)-th node voltage VNn+1 through the second dummy line DML2.

The timing controller 200 may compare the n-th node voltage VNn with the (n+1)-th voltage VNn+1. The timing controller 200 may compensate the data signal DAT so that the n-th node voltage VNn is substantially the same as the (n+1)-th node voltage VNn+1.

The timing controller 200 may compare the n-th node voltage VNn and the (n+1)-th node voltage VNn+1 with a reference voltage VR. The reference voltage VR may be substantially the same as one of the n-th data voltage DVn and the (n+1)-th data voltage DVn+1. The timing controller 200 may compensate the data signal DAT so that the n-th node voltage VNn and the (n+1)-th node voltage VNn+1 is substantially the same as the reference voltage VR.

The timing controller 200 may first compensate the n-th and (n+1)-th data. Next, the timing controller 200 may compensate the (n−1)-th and (n+2)-th data. Next, the timing controller 200 may compensate the (n−2)-th and (n+3)-th data. Accordingly, the timing controller 200 may first compensate the n-th and (n+1)-th data, and may then compensate the other data sequentially in order of closeness to the n-th and (n+1)-th data lines DLn, DLn+1.

The timing controller 200 outputs the compensated data signal to the first and second data drivers 501 and 502.

The first data driver 501 outputs compensated first through n-th data voltages to the first through n-th fan-out lines FL1-FLn based on the compensated data signal. The second data driver 502 outputs compensated (n+1)-th through m-th data voltages to the (n+1)-th through m-th fan-out lines FLn+1-FLm based on the compensated data signal.

The first dummy line DML1 may deliver an n-th node voltage CVNn according to the compensated data signal to the timing controller 200. The second dummy line DML2 may deliver an (n+1)-th node voltage CVNn+1 according to the compensated data signal to the timing controller 200.

The timing controller 200 may compare the n-th node voltage CVNn, according to the compensated data signal, with the (n+1)-th node voltage CVNn+1, according to the compensated data signal. The timing controller 200 may compensate the compensated data signal again so that the n-th node voltage CVNn, according to the compensated data signal, is substantially the same as the (n+1)-th node voltage CVNn+1, according to the compensated data signal, if the n-th node voltage CVNn, according to the compensated data signal, is not substantially the same as the (n+1)-th node voltage CVNn+1, according to the compensated data signal.

The timing controller 200 may repeatedly perform the feedback and the compensation until an n-th node voltage becomes substantially the same as an (n+1)-th node voltage.

The timing controller 200 may compare the n-th node voltage CVNn, according to the compensated data signal, and the (n+1)-th node voltage CVNn+1, according to the compensated data signal, with the reference voltage VR. The timing controller 200 may compensate the compensated data signal again so that the n-th node voltage CVNn according to the compensated data signal and the (n+1)-th node voltage CVNn+1 according to the compensated data signal, are substantially the same as the reference voltage VR if the n-th node voltage CVNn, according to the compensated data signal, and the (n+1)-th node voltage CVNn+1, according to the compensated data signal, are not substantially the same as the reference voltage VR.

The timing controller 200 may repeatedly provide the feedback FB and the compensation until an n-th node voltage and an (n+1)-th node voltage become substantially the same as the reference voltage VR.

Figure 6A:
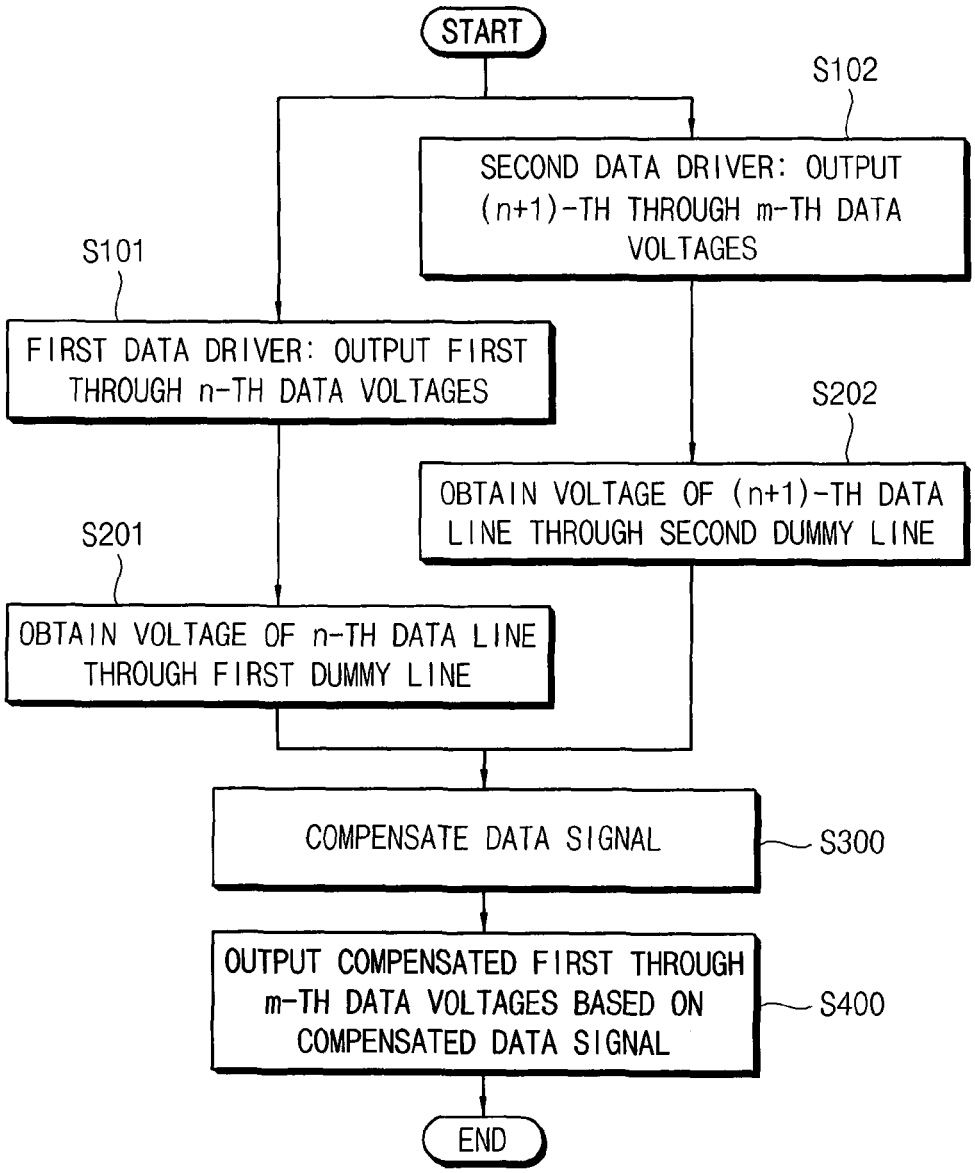
FIG. 6A is a flow chart illustrating a method of driving a display apparatus according to exemplary embodiments of the present invention.
Figure 6B:
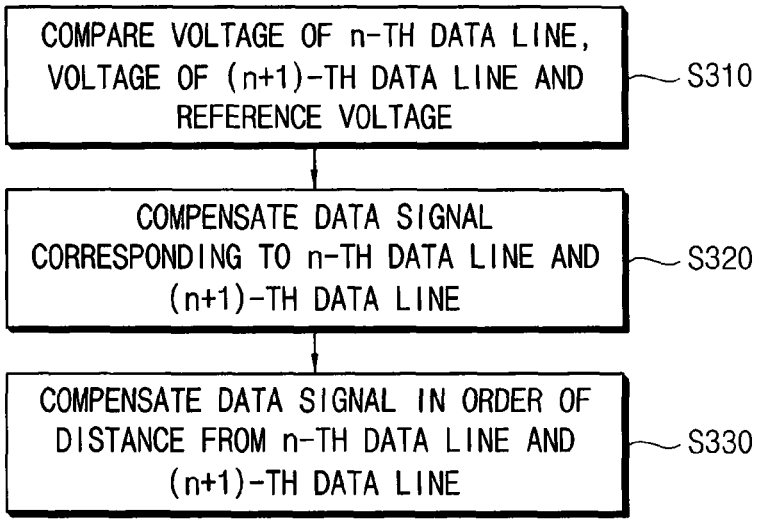
FIG. 6B is a flow chart illustrating a method of compensating a data signal included in a method of driving a display apparatus according to exemplary embodiments of the present invention.

FIG. 6A is a flow chart illustrating a method of driving a display apparatus according to exemplary embodiments of the present invention. FIG. 6B is a flow chart illustrating a method of compensating a data signal included in a method of driving a display apparatus according to exemplary embodiments of the present invention.

Referring to FIGS. 6A and 6B, a first data driver outputs first through n-th data voltages to first through n-th fan-out lines (S101). A second data driver outputs (n+1)-th through m-th data voltages to (n+1)-th through m-th fan-out lines (S102).

A timing controller obtains an n-th node voltage of a node where the n-th fan-out line is connected to an n-th data line through a first dummy line (S201), and obtains an (n+1)-th node voltage of a node where the (n+1)-th fan-out line is connected to an (n+1)-th data line through a second dummy line (S202).

The timing controller compensates a data signal based on the n-th node voltage and the (n+1)-th node voltage (S300). Compensation of the data signals of Step S300 is illustrated in greater detail in FIG. 6B. As may be seen here, the timing controller may compare the n-th node voltage, the (n+1)-th node voltage, and a reference voltage, with each other (S310). The timing controller may compensate data corresponding to the n-th data line and the (n+1)-th data line first (S320). The timing controller may compensate the other data sequentially in order of closeness to the n-th data line and the (n+1)-th data line (S330).

The first data driver outputs compensated first through n-th data voltages to the first through n-th fan-out lines based on the compensated data signal, and the second data driver outputs compensated (n+1)-th through m-th data voltages to the (n+1)-th through m-th fan-out lines based on the compensated data signal (S400).

The above described exemplary embodiments of the present invention may be used in a display apparatus and/or a system including the display apparatus, such as a mobile phone, a smart phone, a personal digital assistant (PDA), a portable media player (PMP), a digital camera, a digital television, a set-top box, a music player, a portable game console or game console controller, a navigation device, a personal computer (PC), a server computer, a workstation, a tablet computer, a laptop computer, a smart card, a printer, etc.

Although a few exemplary embodiments of the present invention have been described, those skilled in the art will readily appreciate that many modifications are possible in the exemplary embodiments without materially departing from the present inventive concept.

What is claimed is:

1. A display apparatus comprising:

a display panel comprising first through m-th fan-out lines, first through m-th data lines, a first dummy line, and a second dummy line, wherein the first through m-th fan-out lines are sequentially disposed along a first direction, wherein the first through m-th data lines are sequentially disposed along the first direction, wherein the first through m-th data lines are connected to the first through m-th fan-out lines at first through m-th nodes, respectively, wherein the first dummy line is connected to only an n-th node, wherein the second dummy line is connected to an (n+1)-th node, and wherein m and n are positive integers and m is greater than n;

a first data driver configured to output first through n-th data voltages to the first through n-th fan-out lines, respectively, based on a data signal;

a second data driver configured to output (n+1)-th through m-th data voltages to the (n+1)-th through m-th fan-out lines, respectively, based on the data signal; and a timing controller configured to compensate the data signal based on a voltage of the n-th node and a voltage of the (n+1)-th node.

2. The display apparatus of claim 1, wherein the timing controller is configured to obtain a voltage of the n-th node through the first dummy line and the timing controller is configured to obtain a voltage of the (n+1)-th node through the second dummy line.

3. The display apparatus of claim 1, wherein the timing controller is configured to compare a voltage of the n-th node with a voltage of the (n+1)-th node.

4. The display apparatus of claim 3, wherein the timing controller is configured to compensate the data signal so that the voltage of the n-th node is substantially the same as the voltage of the (n+1)-th node.

5. The display apparatus of claim 1, wherein the timing controller is configured to compare a voltage of the n-th node and a voltage of the (n+1)-th node with a reference voltage.

6. The display apparatus of claim 5, wherein the timing controller is configured to compensate the data signal so that the voltage of the n-th node and the voltage of the (n+1)-th node are substantially the same as the reference voltage.

7. The display apparatus of claim 5, wherein the reference voltage is substantially the same as either the n-th data voltage or the (n+1)-th data voltage.

8. The display apparatus of claim 1, wherein the timing controller is configured to compensate n-th and (n+1)-th data corresponding to the n-th and (n+1)-th data lines.

9. The display apparatus of claim 8, wherein the timing controller is configured to compensate first through (n−1)-th and (n+2)-th through m-th data corresponding to the first through (n−1)-th and (n+2)-th through m-th data lines, respectively, in order of closeness to the n-th and (n+1)-th data lines, after first compensating the n-th and (n+1)-th data.

10. The display apparatus of claim 1, wherein the first and second data drivers are configured to output compensated first through m-th data voltages to the first through m-th fan-out lines, respectively, based on the compensated data signal.

11. The display apparatus of claim 1, wherein the first and second dummy lines are both disposed between the n-th fan-out line and the (n+1)-th fan-out line.

12. A method of driving a display apparatus, the method comprising:

outputting first through n-th data voltages to first ends of first through n-th fan-out lines, respectively, based on a data signal, wherein n is a positive integer;

outputting (n+1)-th through m-th data voltages to first ends of (n+1)-th through m-th fan-out lines, respectively, based on the data signal, wherein m is a positive integer greater than n;

obtaining an n-th voltage of a second end of the n-th fan-out line through a first dummy line;

obtaining an (n+1)-th voltage of a second end of the (n+11)-th fan-out line through a second dummy line; and compensating the data signal based on the n-th and (n+1)-th voltages, wherein compensating the data signal comprises compensating a data signal corresponding to the n-th and (n+1)-th fan-out lines, and wherein the first through m-th fan-out lines are sequentially disposed along a first direction, and wherein compensating the data signal comprises: compensating a data signal corresponding to the first through (n−1)-th fan-out lines in order of closeness to the n-th fan-out lines, and compensating a data signal corresponding to the (n+2)-th through m-th fan-out lines in order of closeness to the (n+1)-th fan-out lines.

13. The method of claim 12, wherein compensating the data signal comprises: comparing the n-th voltage with the (n+1)-th voltage.

14. The method of claim 13, wherein compensating the data signal further comprises: compensating the data signal so that the n-th voltage is substantially equal to the (n+1)-th voltage.

15. The method of claim 12, wherein compensating the data signal comprises: comparing the n-th and (n+1)-th voltages with a reference voltage.

16. The method of claim 15, wherein compensating the data signal further comprises: compensating the data signal so that the n-th voltage and the (n+1)-th voltage are each substantially equal to the reference voltage.

17. The method of claim 12, further comprising: outputting compensated first through m-th data voltages to the first ends of the first through m-th fan-out lines based on the compensated data signal.

18. A display apparatus, compromising:

a display panel including a first display area and a second display area;

a first data driver for driving the first display area;

a second data driver for driving the second display area;

a first set of fan-out lines connected to the first data driver;

a first set of data lines connected to the first set of fan-out lines and running down the first display area;

a second set of fan-out lines connected to the second data driver;

a second set of data lines connected to the second set of fan-out lines and running down the second display area;

a first dummy line disposed between the first set of fan-out lines and the second set of fan-out lines such that the entirety of the first set of fan-out lines is on a first side of the first dummy line and the entirety of the second set of fan-out lines is on a second side of the first dummy line that is opposite to the first side of the first dummy line; and a second dummy line disposed between the first set of fan-out lines and the second set of fan-out lines such that the entirety of the first set of fan-out lines is on a first side of the second dummy line and the entirety of the second set of fan-out lines is on a second side of the second dummy line that is opposite to the first side of the second dummy line, wherein the first data driver provides a first data signal to the first set of fan-out lines and a first reference signal to the first dummy line, and the second data driver provides a second data signal to the second set of fan-out lines and a second reference signal to the second dummy line.

* * * * *